United States Patent [19]

Davis

[11] 4,116,311

[45] Sep. 26, 1978

[54] LUGGAGE CASE

[75] Inventor: Michael Davis, New Castle, Pa.

[73] Assignee: Airway Industries, Inc., Ellwood City, Pa.

[21] Appl. No.: 855,680

[22] Filed: Nov. 29, 1977

[51] Int. Cl.[2] ..... A45C 3/00

[52] U.S. Cl. ..... 190/49; 190/54

[58] Field of Search ..... 190/49, 50, 54, 53

[56] References Cited

U.S. PATENT DOCUMENTS

| | | | |
|---|---|---|---|
| 1,751,936 | 3/1930 | Lowe | 190/41 Z |
| 1,755,548 | 4/1930 | Lowe | 190/41 Z |
| 1,999,424 | 4/1935 | Steitz | 190/41 Z |
| 3,741,355 | 6/1973 | Slan | 190/49 |
| 3,763,973 | 10/1973 | Taylor | 190/49 |
| 3,812,939 | 5/1974 | Pelletier | 190/49 |

FOREIGN PATENT DOCUMENTS

| | | | |
|---|---|---|---|
| 1,334,614 | 8/1962 | France | 150/28 R |

*Primary Examiner*—Ro E. Hart

*Attorney, Agent, or Firm*—Buell, Blenko & Ziesenheim

[57] ABSTRACT

A luggage case, especially one of the type having the body and covering lid portions of similar frames of open rectangular shape on which the covering material is applied, wherein the peripheral welting at the bottom corner of the body portion and at the top corner of the covering lid are structurally adjusted with respect to the frames so as to more effectively protect the covering material at the peripheral corners of the luggage case against wear and abrasion under use conditions.

3 Claims, 2 Drawing Figures

LUGGAGE CASE

This invention relates to a luggage case of the type having the body and covering lid portions of similar wooden frames of open rectangular shape on which the covering material is applied to the frame in a manner to secure a welting strip at the peripheral bottom corner of the body portion and a welting strip at the peripheral top corner of the covering lid portion.

In tumbling tests which I have conducted to determine the extent to which the covering material at the peripheral corners of the body and covering lid sustain wear under service conditions, it has been established that in the usual way by which the welting is attached to the frame of the body and of the lid, the welting offers little protection against wear and abrasion at the corners of the luggage case, by reason of the fact that the welting is too low, or rather displaced too much inward with respect to the outer edge of the frame of the luggage case.

It is the object of my invention, therefore, to so attach the welting at the peripheral corners of a luggage case, that greater protection to wear of the covering material at the corners of the luggage case is thereby afforded.

To accomplish the above objective, I attach a separate strip of covering material peripherally to the outer edge of the covering material and then bend the outer edge of the additional strip tightly around the outer edge of the wooden frame and bind it together with the periphery of the side pieces of covering material and the tail of the welting strip. It will be seen that the welting is thereby raised, that it brought into alignment, with regard to the wooden frame to provide greater protection of the covering material at the corners of the luggage case.

The invention will be hereinafter described in greater detail, in connection with the accompanying single sheet of drawings, wherein.

Figure 1:
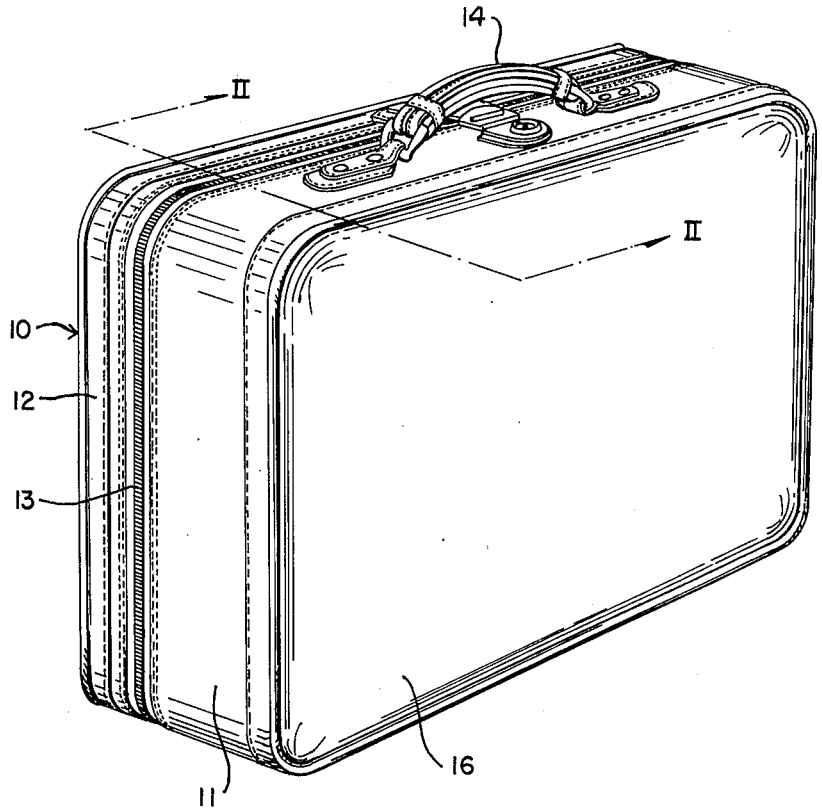
FIG. 1 is a perspective view of a luggage case embodying my invention.

Referring to the drawings, the luggage case 10 shown in FIG. 1, comprises a body portion 11 and a covering lid portion 12 in closed position in which they are retained by a fastener 13, illustratively shown as of the slide type. The handle 14 is suitably attached to the wooden frame 15 of the body portion in a location constituting the top of the luggage case, substantially on a line midway between the opposite side walls 16 and 16' of the luggage case.

Figure 2:
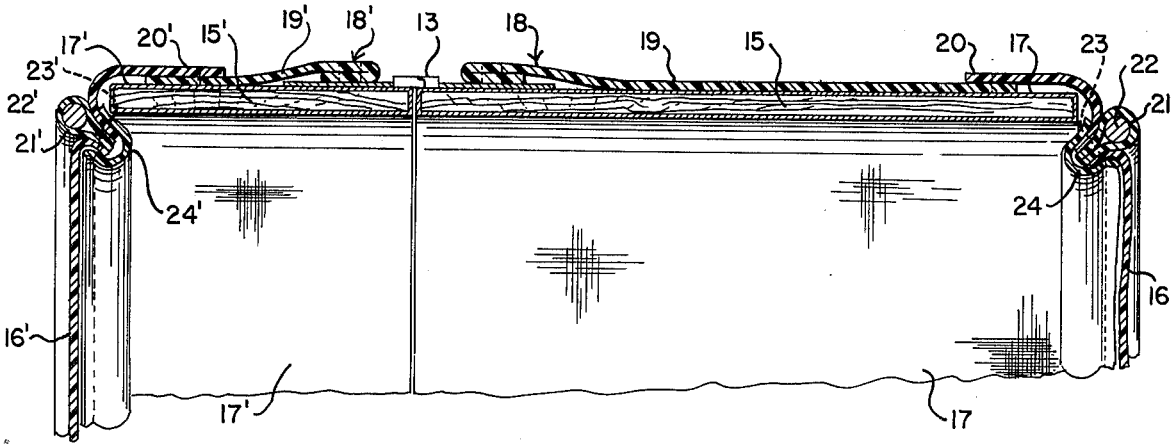
FIG. 2 is a partial sectional view, taken on the line II—II of FIG. 1, showing the manner of application of covering material and of attachment of the welting according to my invention.

As shown in FIG. 2, the body portion of the luggage case comprises a substantially rectangular wooden frame 15 corresponding in width to the depth of the body portion and formed with rounded corners. The frame 15 is tightly covered with a layer of fabric 17 stretched tautly around the frame and secured thereto as by cement or glue. Fabric 17 constitutes the inner lining of the completed luggage case.

A prefabricated cover 18 for the body portion 11 comprises a strip 19, of serviceable covering material, such as vinyl sheet conforming closely to the outer circumferential distance around the frame 15, the side wall 16 of similar or contrasting covering material to the strip 19, a part of the slide fastener 13 attached as by stitching to a doubled-over edge of the strip 19, and a strip 20 of covering material such as vinyl sheet, corresponding in length to that of strip 19 and relatively narrow in width, attached as by stitching to the single-thickness edge of strip 19 opposite the slide fastener 13. The side wall 16 is preferably made of vinyl sheet having the inner surface thereof covered with a fabric material that is the same or closely similar in appearance to the fabric 17.

While the cover 18 is inside-out and providing convenient access for sewing, the outer edge of strip 20, the peripheral edge of side wall 16 and the two edges of a covering strip 21 of material, such as vinyl sheet, surrounding a cord 22 are sewn together at 23 with a suitable outer covering tape 24. It will be understood that the covering strip 21 and cord 22 form a protective welting after the cover is turned back from its inside-out position.

Upon completion of fabrication of the cover 18 and return to its right-side-out position, the cover 18 is ready for installation on the frame 15.

Before going to installation of the cover 18, a brief description will be given of the cover 18' for the lid portion 12.

The lid portion comprises a wooden frame 15' formed in rectangular contour coinciding to that of the frame 15 of the body portion and having a fabric covering 17', similar to the fabric covering 17. The fabric covering 17' constitutes the inner lining of the lid portion 12 of the luggage case.

A prefabricated cover 18' for the lid portion 12 comprises a strip 19' of covering material, such as vinyl sheet, conforming closely to the outer circumferential distance around the frame 15', side wall 16' of similar or contrasting covering material to strip 19', a second part of slide fastener 13, and a strip 20' of covering material, such as vinyl sheet, corresponding in length to that of strip 19' but relatively narrow in width. Strip 20' is attached as by stitching to the single thickness outer edge of strip 19' while the second part of slide fastener 13 is attached, as by stitching, to the doubled-over edge opposite strip 20'. The side wall 16', like the side wall 16, is preferably made of vinyl sheet having the inner surface thereof covered with fabric material closely similar in appearance to the fabric 17'.

While the cover 18' is inside-out and providing convenient access for sewing, the outer edge of strip 20', the peripheral edge of side wall 16', and the two edges of a covering strip 21' of material, such as vinyl sheet, surrounding a cord 22' are sewn together at 23', with a suitable outer covering tape 24'. It will be understood that the covering strip 21' and the cord 22' form a protective welting after the cover 18' is turned back from its inside-out position.

With the completion of the fabrication of covers 18 and 18', they are installed on the body portion 11 and lid portion 12, respectively, by stretching them and pulling them tightly over the respective frames 15 and 15'.

The installation of suitable strips inside and outside of the covers 18 and 18', for hinging the lid and body portions is then done conveniently, as is the installation of internal fixtures and brackets (not shown) and handle 14.

It will be observed that by providing the additional strips 20 and 20' in the covers 18 and 18' respectively, the welting 21 and 21' is positioned more nearly in alignment with the plane of the wooden frames 15 and 15', in contrast to covers wherein the covering strip, corresponding to strips 19, 19' are stitched directly to the welting. I have found, by tumbling tests, that this construction employing the extra strips 20 and 20', causes the welting to assume the brunt of the blows and wear on the corner edges of the luggage case under service conditions, thus more effectively protecting and guarding the corner edge of covering material from abrasion and wear.

While a specific preferred embodiment of the invention is herein shown and described, it will be apparent that modifications and variations may be made therein within the terms of the appended claims.

I claim:

1. In a luggage case of the type comprising a body portion and a covering lid portion, respectively having substantially rectangular frames of corresponding contour, and covers which are stretched tautly over said frames, the improvement wherein each of said covers comprises a portion of a single thickness of covering material surrounding each of the said frames, a side wall portion for each of said frames of a single thickness of covering material, a relatively narrow strip of a single thickness of covering material coextensive in length to the surrounding portion and attached adjacent to the outer edge of the surrounding portion of covering material and projecting therebeyond, and corner edge welting attached between the outer edge of said separate strip and the periphery of the side wall portions of the covers.

2. In a luggage case of the type comprising two hinged portions, similarly made of substantially rectangular open frames and covering material for said frames, the improvement wherein the covering material for each of said frames includes a separate strip of sheet material coextensive in length therewith and attached to a layer of the covering sheet material adjacent the outer edge of the frames, and a welting cord is attached between the outer edge of said separate strip and the periphery of the side wall covering for said frame, whereby said welting is positioned in substantial alignment with the plane of the frame to protect the covering material at the corner edge of said case from wear and abrasion under service conditions.

3. The method of making a cover for a luggage case so as to more effectively guard and protect the corner edges of the luggage case from abasion and wear, which method comprises the steps of:

(a) providing a cover having a single thickness of covering material to surround the frame of the luggage case, (b) providing a separate relatively narrow strip of covering material to surround the single thickness covering material of said covers in adjacent parallel relation to the outer edge of the frame, (c) attaching said relatively narrow strip of covering material to said cover so that said strip forms the outer periphery thereof, and (d) attaching a welting cord between the outer edge of said strip and the outer periphery of the covering material forming a side wall for the luggage case.

* * * * *

UNITED STATES PATENT AND TRADEMARK OFFICE

CERTIFICATE OF CORRECTION

PATENT NO. : 4,116,311

DATED : September 26, 1978

INVENTOR(S) : Michael Davis

It is certified that error appears in the above-identified patent and that said Letters Patent are hereby corrected as shown below:

Column 1, line 33, "it" should read --is--.

Column 4, claim 3, line 15, "abasion" should read --abrasion--.

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*